US010464128B2

(12) United States Patent
Imahase et al.

(10) Patent No.: US 10,464,128 B2
(45) Date of Patent: Nov. 5, 2019

(54) SLIDE METAL FRAME-DRIVE UNIT COUPLING POSITION SWITCHING MECHANISM FOR A SLIDING NOZZLE APPARATUS

(71) Applicant: KROSAKIHARIMA CORPORATION, Fukuoka (JP)

(72) Inventors: Toshihiro Imahase, Fukuoka (JP); Junichi Funato, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 271 days.

(21) Appl. No.: 15/527,473

(22) PCT Filed: Nov. 17, 2015

(86) PCT No.: PCT/JP2015/082220
§ 371 (c)(1),
(2) Date: May 17, 2017

(87) PCT Pub. No.: WO2016/080378
PCT Pub. Date: May 26, 2016

(65) Prior Publication Data

US 2018/0333773 A1 Nov. 22, 2018

(30) Foreign Application Priority Data

Nov. 18, 2014 (JP) ..... 2014-233703

(51) Int. Cl.
*B22D 41/38* (2006.01)
*B22D 41/34* (2006.01)

(52) U.S. Cl.
CPC ..... *B22D 41/38* (2013.01); *B22D 41/34* (2013.01)

(58) Field of Classification Search
CPC ..... B22D 41/34; B22D 41/38
(Continued)

(56) References Cited

U.S. PATENT DOCUMENTS 6,276,573 B1 8/2001 Tofuku et al.
8,002,155 B2 * 8/2011 Mitsui ..... B22D 41/40 222/600
9,505,056 B2 * 11/2016 Yamamoto ..... B22D 41/38

FOREIGN PATENT DOCUMENTS

JP 2001-40691 A 2/2001
JP 2007326120 A 12/2007
(Continued)

OTHER PUBLICATIONS

International Preliminary Report on Patentability dated May 23, 2017 for PCT/JP2015/082220 filed Nov. 17, 2015.
(Continued)

*Primary Examiner* — Jessee R Roe
*Assistant Examiner* — Michael Aboagye
(74) *Attorney, Agent, or Firm* — Paul D. Bianco; Fleit Gibbons Gutman Bongini & Bianco PL

(57) ABSTRACT

A coupling position switching mechanism capable of improving efficiency of a coupling position switching operation, while realizing structural simplification, and reductions in size and cost. A first coupling portion consisting of one of a slide metal frame-side coupling portion and a drive unit-side coupling portion is formed with a groove-shaped recess and a through-hole in this order from the side of a distal end of the first coupling portion, and a second coupling portion consisting of the remaining one of the slide metal frame-side coupling portion and the drive unit-side coupling portion is formed with the through-hole. The first and second coupling portions are configured such that, during a casting operation, they are coupled together by a coupling pin inserted into the through-hole of the first coupling portion and the through-hole of the second coupling portion, and during surface pressure-applying/releasing operation, they are coupled together by a second coupling pin inserted into the groove-
(Continued)

shaped recess of the first coupling portion and the through-hole of the second coupling portion.

7 Claims, 9 Drawing Sheets

(58) Field of Classification Search
USPC ..... 266/236; 222/590, 591, 597, 600, 601, 222/606
See application file for complete search history.

(56) References Cited

FOREIGN PATENT DOCUMENTS

| | | | | |
|---|---|---|---|---|
| JP | 5283772 | * | 6/2013 | ..... B22D 41/34 |
| JP | 2014-8512 A | | 1/2014 | |
| WO | 00/50188 A1 | | 8/2000 | |

OTHER PUBLICATIONS

Written Opinion dated Apr. 5, 2017 for PCT/JP2015/082220 filed Nov. 17, 2015.
International Search Report dated Jan. 27, 2016 for PCT/JP2015/082220 filed Nov. 17, 2015.
Written Opinion dated Jan. 27, 2016 for PCT/JP2015/082220 filed Nov. 17, 2015.

* cited by examiner

SLIDE METAL FRAME-DRIVE UNIT COUPLING POSITION SWITCHING MECHANISM FOR A SLIDING NOZZLE APPARATUS

TECHNICAL FIELD

The present invention relates to a mechanism for switchably changing a coupling position between a slide metal frame and a drive unit in a sliding nozzle apparatus for controlling a flow rate of molten metal.

BACKGROUND ART

A sliding nozzle apparatus is configured such that one of two or three refractory plates having a nozzle hole is slidingly moved while they are clamped at a high pressure (while they are applied with a surface pressure therebetween), to thereby change a degree of opening of the nozzle hole to control a flow rate of molten metal. This slidingly-movable plate (i.e., sliding plate) is held by a slide metal frame, which is provided in an openable and closable manner so as to enable the sliding plate to be replaced with a new one.

The sliding plate reaches its usable life after it is used only several times. Thus, there is a need to replace the sliding plate with a new one or check a damage state of the sliding plate, by opening the slide metal frame. In this case, it is necessary to release the surface pressure before opening the slide metal frame, and then apply the surface pressure again after closing the slide metal frame.

As a way to apply and release the surface pressure in the sliding nozzle apparatus, there has been known a technique of applying and releasing the surface pressure by means of sliding movement (sliding displacement) of the slide metal frame. That is, this technique is configured to cause a spring to be deformed by using a driving force during sliding movement of the slide metal frame. In this technique, a slide range (movable range) of the slide metal frame during an operation of applying or releasing the surface pressure is set to go beyond a slide range during a casting operation. Thus, in case of using two types of drive units (typically cylinder units) having different strokes between during the casting operation and during the surface pressure applying/releasing operation, there is a problem that it is necessary to additionally ensure a holding means and an installation space for a second, extra, one of the drive units.

On the other hand, there has also been proposed another technique of switchably changing the coupling position between the drive unit and the slide metal frame, by using one drive unit.

For example, the following Patent Document 1 discloses a coupling position switching mechanism configured to couple a drive unit and a slide casing (slide metal frame) through a guide piece, and switchably change a coupling position between the drive unit and the guide piece, within an opening provided in the guide piece by using a coupling pin. This guide piece is configured to be moved linearly based on a guide rail provided on a base frame, and an extension guide disposed to be slidingly moved along the guide rail in an extendable manner.

More specifically, as depicted in FIGS. 9 and 10, the guide piece 24 is provided with two, first and second, coupling holes 40, 41, whereby a coupling position between the guide piece 24 and a protruding portion 77*e* of a rod 7A serving as a coupling member can be switchably changed between during the casting operation and during the surface pressure applying/releasing operation, by selectively inserting a coupling pin 42 into one of the coupling holes 40, 41 and a coupling hole 77Aa formed in the protruding portion 77*e*.

Further, as a means to position the protruding portion 77*e*, the guide piece 24 is formed with a first positioning surface a for use during the surface pressure applying/releasing operation, and a second positioning surface b for use during the casting operation. The first positioning surface a and the second positioning surface b are formed such that each of the first and second coupling holes 40, 41 and the coupling hole 77Aa of the protrusion portion 77*e* are coaxially arranged at each of the coupling positions, so as to enable the coupling pin 42 to be easily inserted thereinto and pulled out therefrom at each of the coupling portions.

However, in the coupling position switching mechanism disclosed in Patent Document 1, an operation of inserting and pulling out the coupling pin 42 is required every time the coupling position is switchably changed, thereby leading to a problem of deterioration in. efficiency of the switching operation The coupling position switching mechanism disclosed in Patent Document 1 is also constructed such that the positioning surfaces a, b are provided in two areas within the opening of the guide piece 24 as described above so as to facilitate insertion and pull-out of the coupling pin 42. Further, the guide piece 24 is constructed such that a pair of the extension guides are provided bilaterally and slidingly moved, respectively, along a pair of the guide rails provided on the base frame, thereby leading to a problem that the coupling position switching mechanism becomes structurally complicated.

Moreover, the guide piece 24 is provided with a connection portion attachable and detachable with respect to the slide casing 4, thereby leading to a problem that the guide piece 24 is increased in size. Specifically, the guide piece 24 is subject to large stress under high temperatures during sliding movement. Thus, the connection portion attachable and detachable with respect to the slide casing 4 needs to be increased in size so as to be strengthened. For the same reason, a portion of the guide piece 24 defining the opening and a sliding surface also needs to be increased in size so as to be strengthened, so that a problem arises that the coupling position switching mechanism is increased in size and cost.

CITATION LIST

Patent Document

Patent Document 1: JP 5283772B

SUMMARY OF INVENTION

Technical Problem

A technical problem addressed by the invention is to provide a coupling position switching mechanism capable of improving efficiency of a coupling position switching operation, while realizing structural simplification, and reductions in size and cost.

Solution to Technical Problem

According to one aspect of the present invention, there is provided a slide metal frame-drive unit coupling position switching mechanism for use in a sliding nozzle apparatus configured such that a slide metal frame is slidingly moved with respect to a fixed metal frame according to forward and backward movements of a drive unit, to thereby apply and release a surface pressure in the sliding nozzle apparatus. The coupling position switching mechanism is operable to switchably change a coupling position between a slide metal frame-side coupling portion provided in the slide metal frame and a drive unit-side coupling portion provided in the drive unit, wherein a first coupling portion consisting of one of the slide metal frame-side coupling portion and the drive unit-side coupling portion is formed with a groove-shaped recess and a through-hole, and a second coupling portion consisting of the remaining one of the slide metal frame-side coupling portion and the drive unit-side coupling portion is formed with a through-hole, wherein the first coupling portion and the second coupling portion are configured such that, during a casting operation, they are coupled together by a first coupling pin inserted into the through-hole of the first coupling portion and the through-hole of the second coupling portion, and during a surface pressure-applying/releasing operation, they are coupled together by a second coupling pin inserted into the groove-shaped recess of the first coupling portion and the through-hole of the second coupling portion".

Effect of Invention

In the present invention, during surface pressure-applying/releasing operation, the first coupling portion and the second coupling portion are coupled together by the second coupling pin inserted into the groove-shaped recess of the first coupling portion and the through-hole of the second coupling portion. That is, the first and second coupling portions are coupled together by using the "groove-shaped recess" of the first coupling portion, so that it is possible to open and close the slide metal frame without inserting and pulling out the during-surface pressure-applying/releasing coupling pin (second coupling pin) after releasing the surface pressure, and thus improve the operation efficiency. Moreover, during the surface pressure-applying/releasing operation, there is no need to ensure a high degree of matching or alignment accuracy between the "groove-shaped recess" and the "through-hole", so that it becomes possible to set a width of the groove-shaped recess to a value greater than an inner diameter of the through-hole, and thus facilitate the positional alignment between the "groove-shaped recess" and the "through-hole". From this point, the operation efficiency can also be improved.

Furthermore, the present invention makes it possible to eliminate a need for the "guide piece" employed in Patent Document 1, thereby realizing structural simplification and reductions in size and cost.

DESCRIPTION OF EMBODIMENTS

Figure 1:
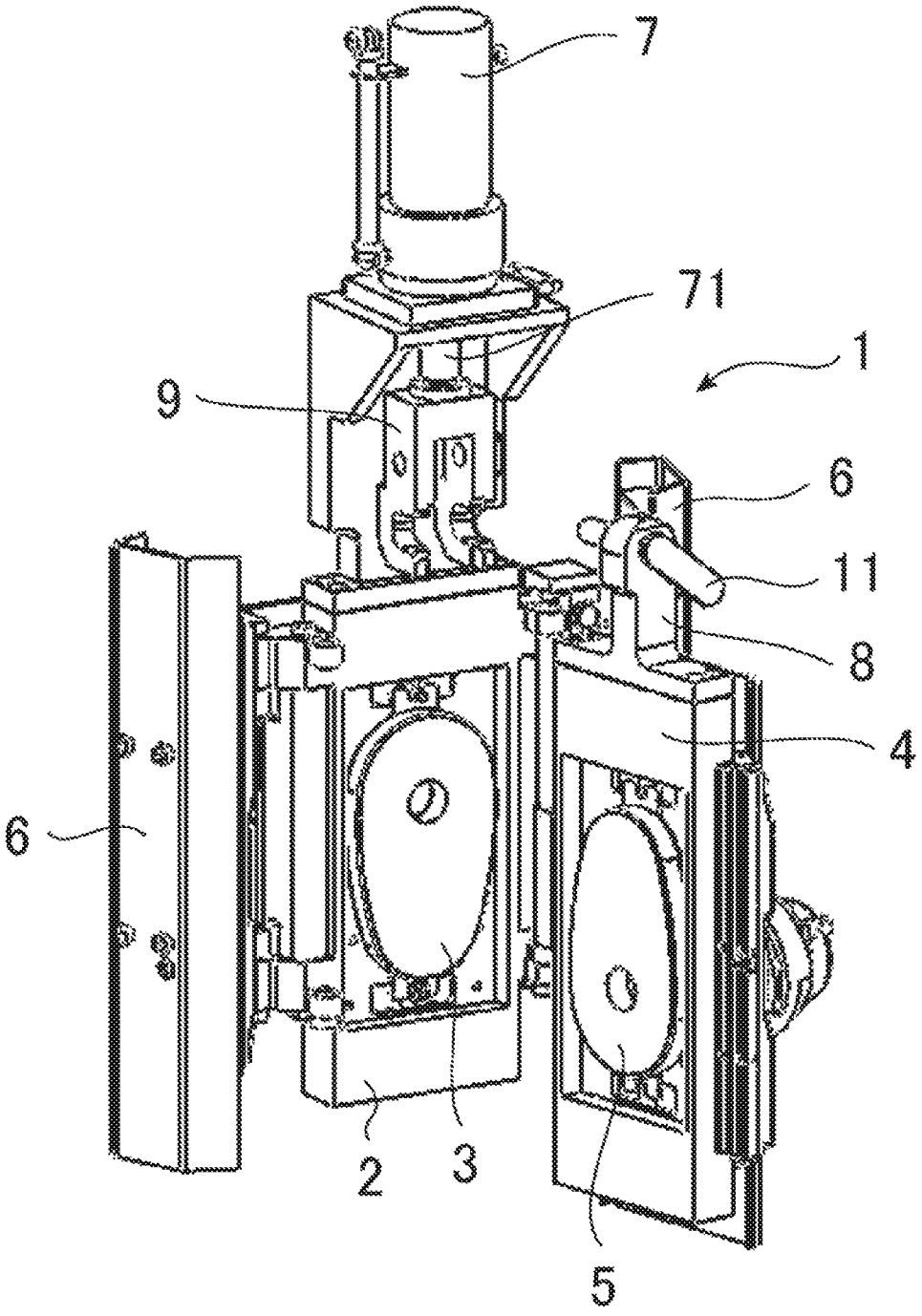
FIG. 1 is a perspective view depicting a sliding nozzle apparatus employing a coupling position switching mechanism according to one embodiment of the present invention, wherein it is in a state in which a slide metal frame is opened after releasing a surface pressure.

FIG. 1 is a perspective view depicting a sliding nozzle apparatus employing a coupling position switching mechanism according to one embodiment of the present invention, wherein it is in a state in which a slide metal frame is opened after releasing a surface pressure.

The sliding nozzle apparatus 1 depicted in FIG. 1 comprises a fixed metal frame 2 attached to a bottom of a molten metal vessel such as a ladle, a slide metal frame 4 provided in a slidable manner and in an openable and closable manner with respect to the fixed metal frame 2, and two openable-closable metal frames 6 which are openably and closably attached to the fixed metal frame 2. The openable-closable metal frame is provided with a spring for applying the surface pressure. The fixed metal frame 2 and the slide metal frame 4 clampingly hold an upper plate 3 and a lower plate 5, respectively. Further, in order to for slidingly move the slide metal frame 4 linearly with respect to the fixed metal frame 2, a hydraulic cylinder 7 as a drive unit is attached to the fixed metal frame 2.

The aforementioned plate-checking/replacing operation and surface pressure-applying/releasing operation are performed in a state in which the sliding nozzle apparatus 1 is disposed to stand vertically. Accordingly, FIG. 1 depicts the sliding nozzle apparatus 1 in a vertically standing state. During surface pressure-applying/releasing operation, the hydraulic cylinder 7 is located just above the sliding nozzle apparatus 1, and a central axis of the drive rod 71 of the hydraulic cylinder 7 and a longitudinal center axis of the slide metal frame 4 are located in the same straight line.

A mechanism for switchingly changing a coupling position between the slide metal frame 4 and the hydraulic cylinder 7 in the sliding nozzle apparatus depicted in FIG. 1 comprises a slide metal frame-side coupling portion 8 provided in the slide metal frame 4, a drive unit-side coupling portion 9 provided at a distal end of the drive rod 71 of the hydraulic cylinder 7, and an L-shaped during-casting coupling pin 10 (see FIG. 2) and a U-shaped during-surface pressure-applying/releasing coupling pin 11 each serving as a coupling pin.

Figure 3:
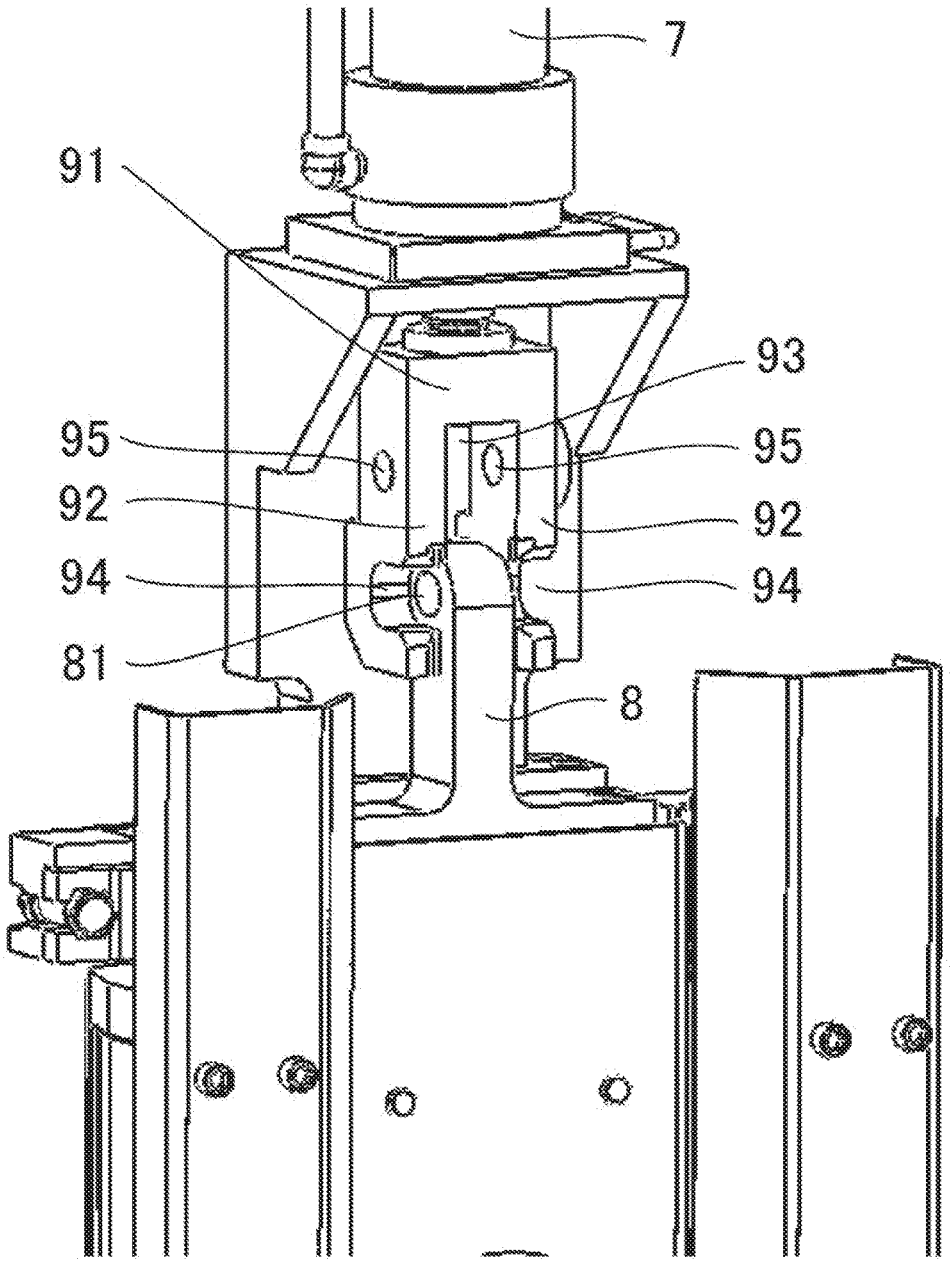
FIG. 3 is a perspective view depicting the coupling position switching mechanism according to this embodiment, in a state in which a groove-shaped recess of the drive unit-side coupling portion and the through-hole of the slide metal frame-side coupling portion are aligned with each other.

As appearing in FIG. 3, the drive unit-side coupling portion 9 comprises a base end frame 91 and two opposing parallel frames 92 each extending from the base end frame 91 in a sliding direction of the slide metal frame 4. The two opposing parallel frames are arranged to define therebetween a space 93 for allowing the slide metal frame-side coupling portion 8 to be fittingly inserted. Each of the two parallel frames 92 has a distal end formed with a groove-shaped recess 94 opened on a side opposite to the fixed metal frame, and a base end (an end on the side of the hydraulic cylinder 7) formed with a through-hole 95. Each of a set of the groove-shaped recesses 94 and a set of the through-holes 95 in the two parallel frames 92 are coaxially located in a direction perpendicular to the sliding direction.

On the other hand, the slide metal frame-side coupling portion 8 extends from a center region of an upper end of the slide metal frame along the longitudinal center axis of the slide metal frame, and has a through-hole 81 in a distal end thereof. The slide metal frame-side coupling portion 8 is configured such that the distal end thereof is brought into contact with the base end frame 91 of the drive unit-side coupling portion 9, and the respective through-holes 95, 81 of the two coupling portions are aligned (matched) with each other.

Each of the groove-shaped recesses 94 of the drive unit-side coupling portion 9 has a sliding directional width set greater than an inner diameter of the through-hole 81 of the slide metal frame-side coupling portion 8.

Next, the procedure of surface pressure-applying/releasing operation will be described.

First of all, the procedure of the surface pressure-releasing operation will be described.

Figure 2:
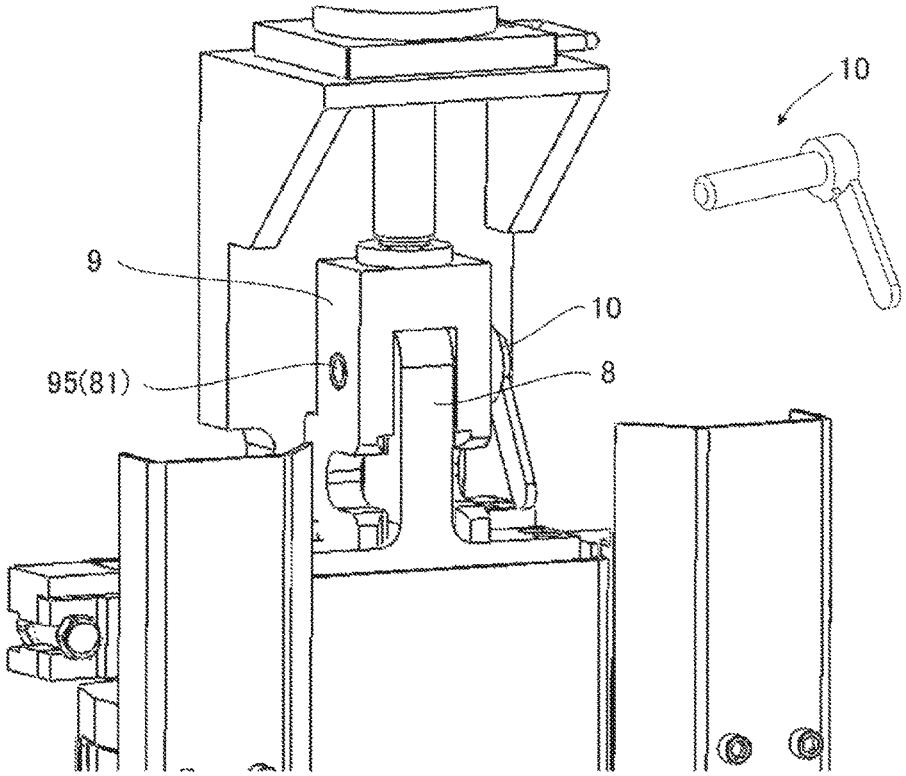
FIG. 2 is a perspective view depicting the coupling position switching mechanism according to this embodiment, in a state in which a drive unit and a slide metal frame are coupled together by inserting a during-casting coupling pin into a through-hole of a drive unit-side coupling portion and a through-hole of a slide metal frame-side coupling portion.

1) In FIG. 2 which depicts a coupled state during a casting operation, the L-shaped during-casting coupling pin 10 penetrating through the through-hole 95 of the drive unit-side coupling portion 9 and the through-hole 81 of the slide metal frame-side coupling portion 8 is pulled out.

2) The hydraulic cylinder 7 is moved backward such that the groove-shaped recess 94 of the drive unit-side coupling portion 9 and the through-hole 81 of the slide metal frame-side coupling portion 8 are aligned with each other, as depicted in FIG. 3.

Figure 4:
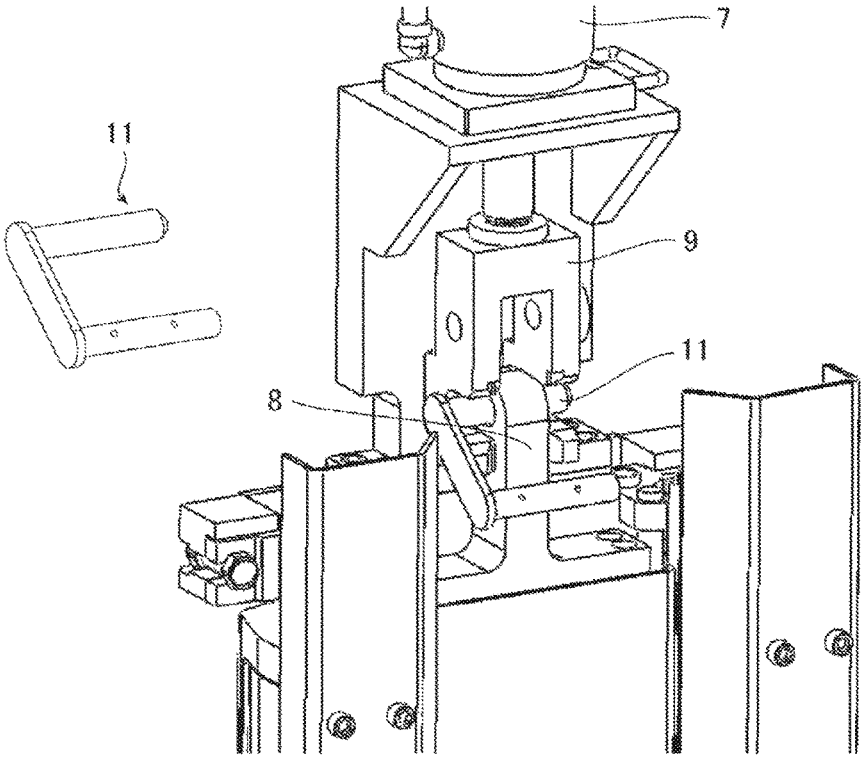
FIG. 4 is a perspective view depicting the coupling position switching mechanism according to this embodiment, in a state in which a during-surface pressure-applying/releasing coupling pin is inserted into the groove-shaped recess of the drive unit-side coupling portion and the through-hole of the slide metal frame-side coupling portion to couple the two coupling portions together, and the surface pressure is released.

3) As depicted in FIG. 4, the U-shaped during-surface pressure-applying/releasing coupling pin 11 is inserted into the groove-shaped recess 94 of the drive unit-side coupling portion 9 and the through-hole 81 of the slide metal frame side-coupling portion 8, to couple the two coupling portions together, and then the hydraulic cylinder 7 is moved to a forward limit position. As a result, the surface pressure is released.

4) After the surface pressure is released, as depicted in FIG. 1, the slide metal frame 4 is opened without pulling out the during-surface pressure-applying/releasing coupling pin 11.

Next, the procedure of the surface pressure-applying operation will be described.

5). After completion of an operation for checking or replacing the plates (the upper plate 3 and the lower plate 5), the slide metal frame 4 is closed to establish the state in FIG. 4.

Figure 5:
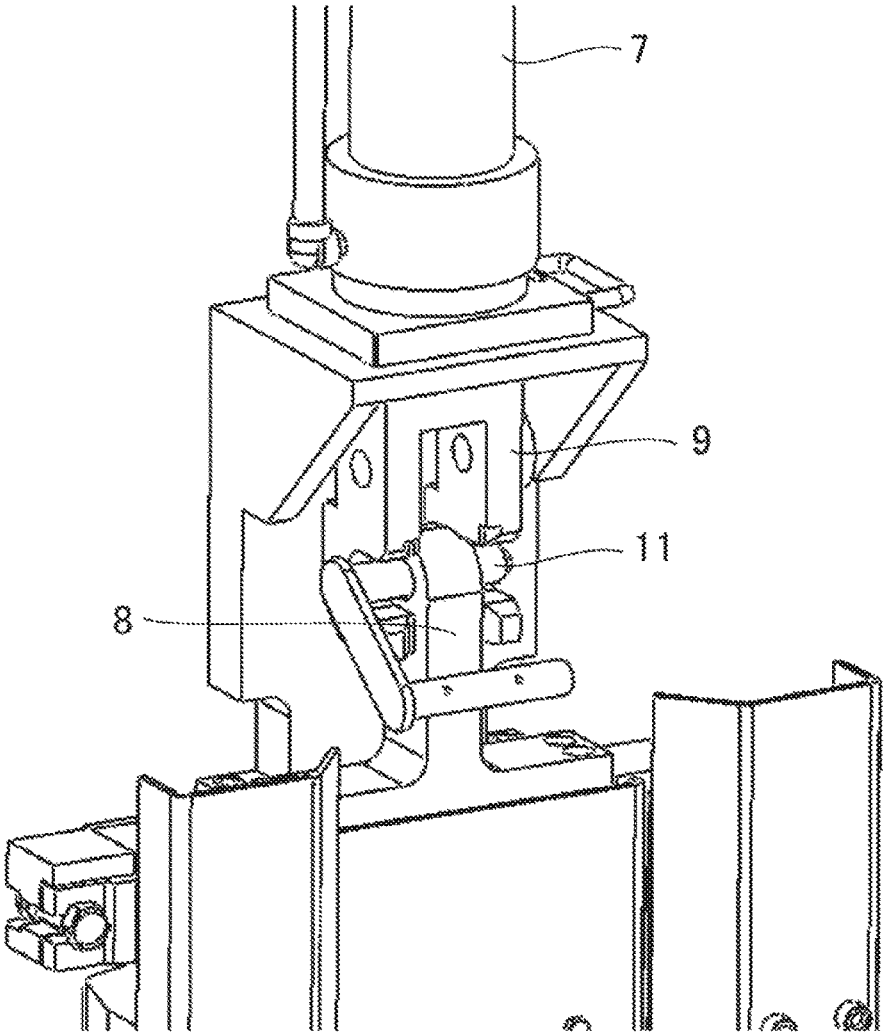
FIG. 5 is a perspective view depicting a state in which the surface pressure is applied by moving the drive unit from a surface pressure releasing position depicted in FIG. 4 to a backward limit position.

6) The hydraulic cylinder 7 is moved to a backward limit position to apply the surface pressure between the plates (FIG. 5).

Figure 6:
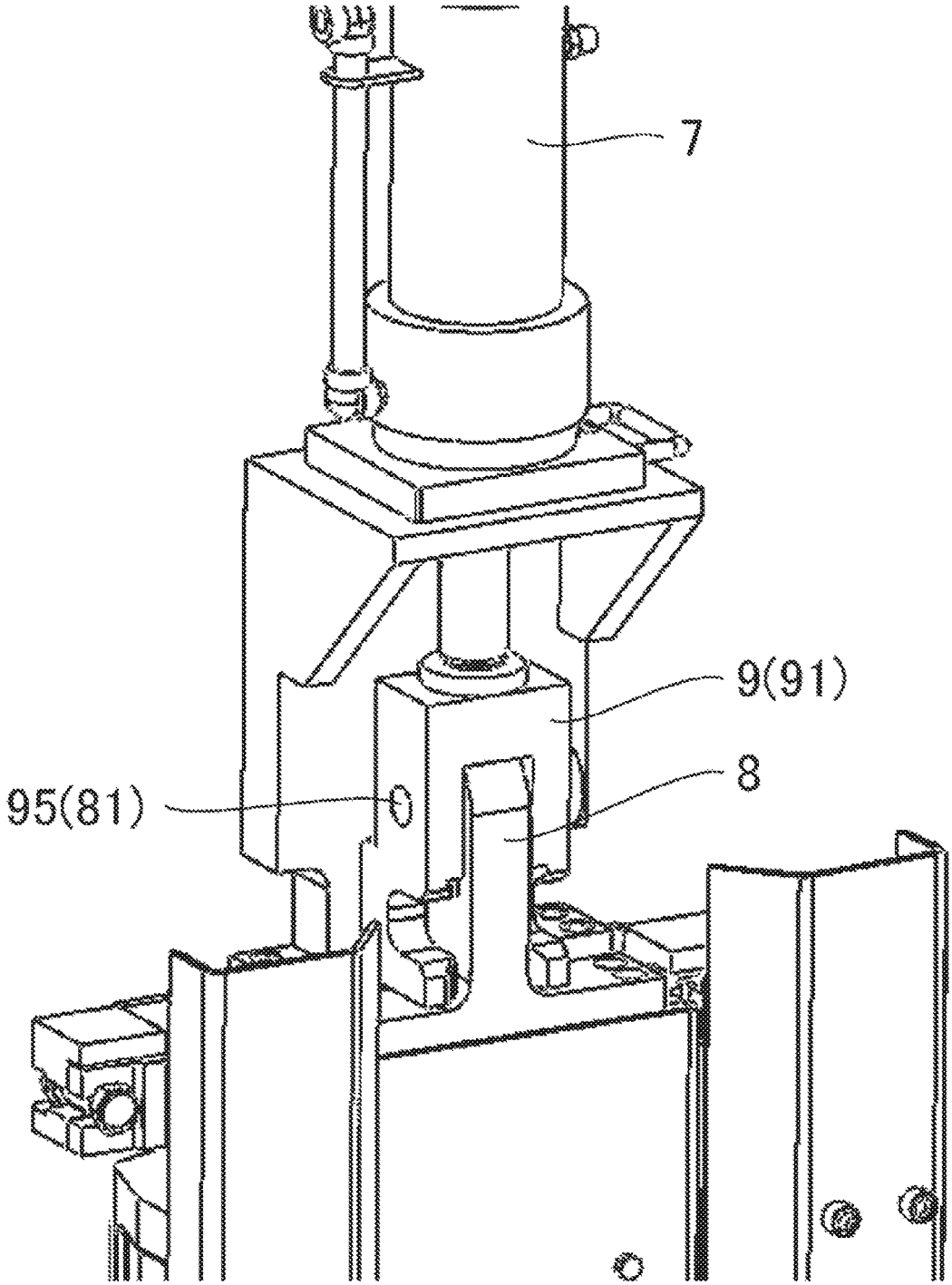
FIG. 6 is a perspective view depicting the coupling position switching mechanism according to this embodiment, in a state in which the through-hole of the drive unit-side coupling portion and the through-hole of the slide metal frame-side coupling portion are aligned with each other.

7) After pulling out the during-surface pressure-applying/releasing coupling pin 11, the hydraulic cylinder 7 is moved to the forward limit position such that the base end frame 91 of the drive unit-side coupling portion is brought into contact with the distal end of the slide metal frame-side coupling portion 8 (FIG. 6).

Figure 7:
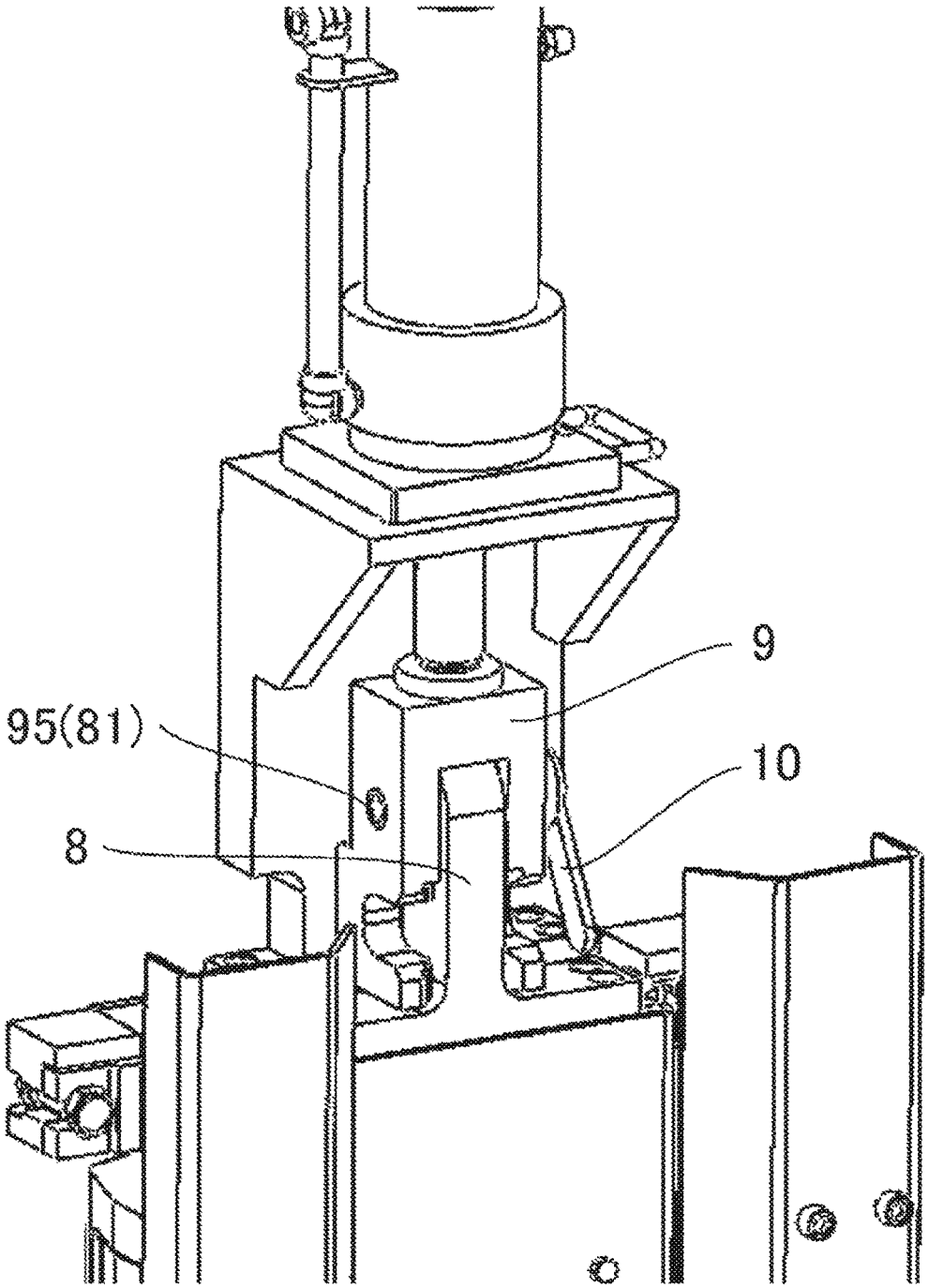
FIG. 7 is a perspective view depicting the coupling position switching mechanism according to this embodiment, in a state in which the during-casting coupling pin is inserted into the through-hole of the drive unit-side coupling portion and the through-hole of the slide metal frame-side coupling portion to couple the two coupling portions together.

8) In this state, the through-hole 95 of the drive unit-side coupling portion and the through-hole 81 of the slide metal frame-side coupling portion are aligned with each other. Thus, the during-casting coupling pin 10 can be inserted thereinto (FIG. 7).

As above, in this embodiment, the drive unit-side coupling portion 9 is formed with the groove-shaped recess 94 opened on a side opposite to the fixed metal frame at the distal end of the drive unit-side coupling portion 9, and during a surface pressure-applying/releasing operation, the during-surface pressure-applying/releasing coupling pin 11 is inserted into the groove-shaped recess 94 and the through-hole 81 of the slide metal frame side-coupling portion 8, to couple the two coupling portions together, so that it is possible to open and close the slide metal frame without inserting and pulling out the during-surface pressure-applying/releasing coupling pin 11 after releasing the surface pressure, and thus improve the operation efficiency. Moreover, during the surface pressure-applying/releasing operation, there is no need to ensure a high degree of matching or alignment accuracy between the groove-shaped recess 94 and the through-hole 81, so that it becomes possible to set a width of the groove-shaped recess 94 to a value greater than an inner diameter of the through-hole 81, and thus facilitate the positional alignment between the groove-shaped recess 94 and the through-hole 81. In addition, the operator can visually check the positional relationship between the groove-shaped recess 94 and the through-hole 81 while operating the hydraulic cylinder 7, so that the operation of the hydraulic cylinder can be minimized. Therefore, the operation efficiency can be improved.

Moreover, in this embodiment, the drive unit-side coupling portion 9 comprises a base end frame 91 and two opposing parallel frames 92 each extending from the base end frame 91 in the sliding direction, and is constructed such that the slide metal frame-side coupling portion 8 is fittingly inserted between the two opposing parallel frames 92. Thus, it is possible to make the construct compact (small size) and strong enough to withstand a driving force during sliding movement of the slide metal frame. Further, in the construct of the present embodiment, the central axis of the drive rod 71 of the hydraulic cylinder 7 and the longitudinal center axis of the slide metal frame 4 are aligned with each other. Therefore, the driving force of the hydraulic cylinder 7 can be smoothly transmitted to the slide metal frame 4.

As previously described with reference to FIG. 1, in the coupling position switching mechanism according to this embodiment, the drive unit is located just above the sliding nozzle apparatus during surface pressure-applying/releasing operation. Then, by employing a structure in which the groove-shaped recess 94 provided at the distal end of the drive unit-side coupling portion 9 and the through-hole 81 of the slide metal frame-side coupling portion 8 are coupled by the during-surface pressure-applying/releasing coupling pin 11, it becomes possible to slidingly move the slide metal frame toward a side opposite the drive unit so as to go beyond the slide range (stroke range) during a casting operation. More specifically, the slide metal frame can be slidingly moved farther downwardly by a distance between the groove-shaped recess 94 and the through-hole 95 of the drive unit-side coupling portion 9. That is, when the slide metal frame is located at a lowermost position in the sliding range, a surface pressure released state can be established. Then, even when the slide metal frame is opened, and the coupling between the drive unit and the slide metal frame is released, the slide metal frame is still held by a hinge portion associated with the fixed metal frame, in a safety manner without any downward displacement of the slide metal frame by gravity.

The coupling position switching mechanism of the present invention is also applicable to the case where the drive unit is located just below the sliding nozzle apparatus during the surface pressure-applying/releasing operation. In this case, from a viewpoint of preventing downward displacement of the slide metal frame during opening/closing thereof, the sliding nozzle apparatus may be configured such that the surface pressure is released when the drive unit is moved to the backward limit position. However, when the coupling position switching mechanism of the present invention is applied to in such a configuration, the drive unit-side coupling portion has a distal end formed with the through-hole, and a drive unit-side end (base end) formed with the groove-shaped recess. As a result, the drive unit-side coupling portion is configured such that the through-hole of the distal end is used for the coupling during a casting operation. Thus, the groove-shaped recess portion of the base end can lead to a problem that the drive unit-side coupling portion is likely to undergo distortion or deformation. This problem can be solved by increasing rigidity of the drive unit-side coupling portion. However, from a viewpoint of reliably preventing distortion or deformation of the drive unit-side coupling portion due to the influence of the groove-shaped recess, the coupling position switching mechanism is preferably configured such that the drive unit is located just above the sliding nozzle apparatus during the surface pressure-applying/releasing operation.

In this embodiment, in order to prevent drop-out of the during-surface pressure-applying/releasing coupling pin 11*a* due to a centrifugal force when the slide metal frame 4 is opened after completion of the surface pressure-applying/releasing operation, the during-surface pressure-applying/releasing coupling pin 11*a* is formed in a U shape, differently from the during-casting coupling pin 10. Alternatively, each of the during-casting coupling pin 10 and the during-surface pressure-applying/releasing coupling pin 11 may be formed as a common coupling pin having an L shape or the like.

Figure 8:
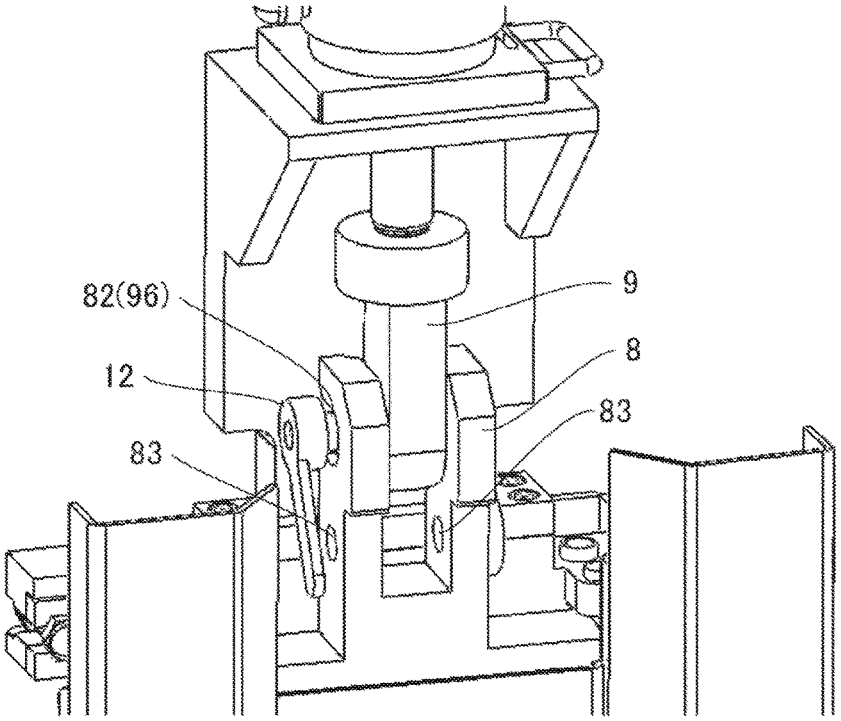
FIG. 8 is a perspective view depicting a coupling position switching mechanism according to another embodiment of the present invention, in a state during a surface pressure-applying/releasing operation.
Figure 9:
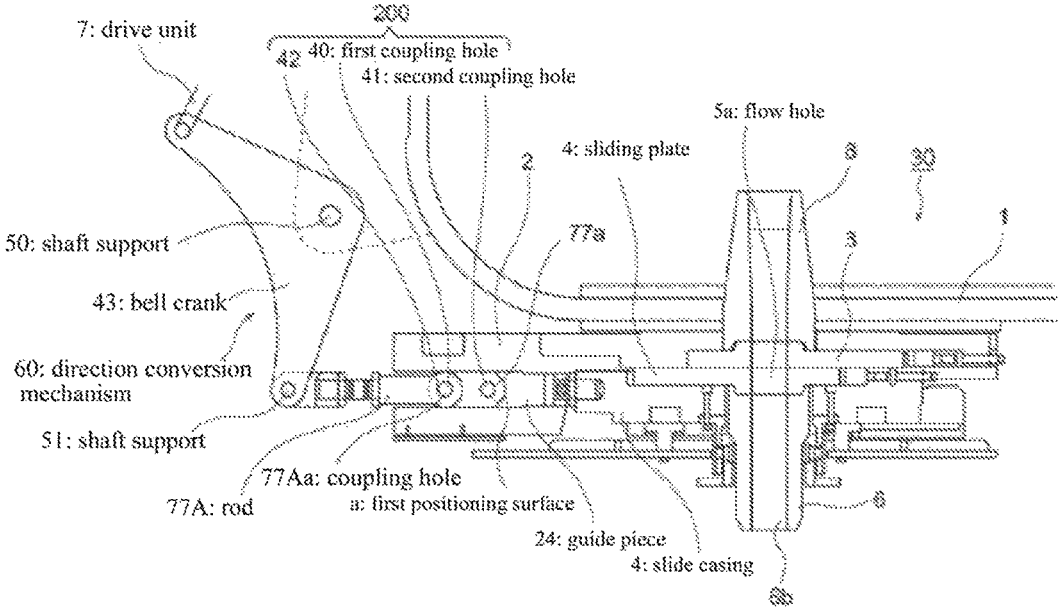
FIG. 9 (PRIOR ART)
FIG. 9 is a front view depicting a conventional coupling position switching mechanism (disclosed in Patent Document 1).
Figure 10:
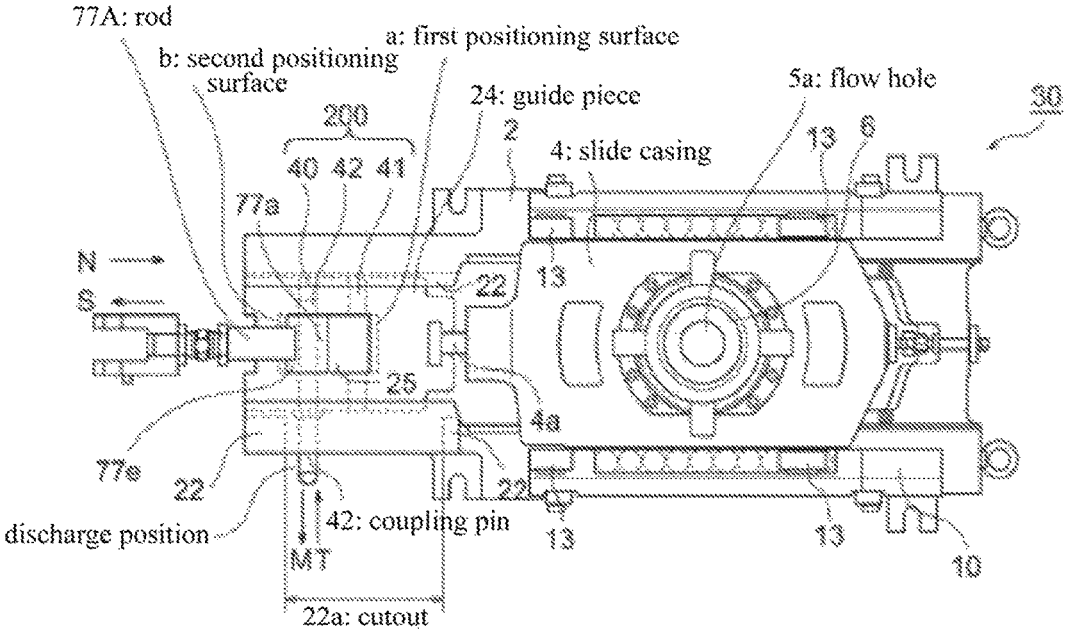
FIG. 10 (PRIOR ART)
FIG. 10 is a plan view depicting the conventional coupling position switching mechanism (disclosed in Patent Document 1).

FIG. 8 is a perspective view depicting a coupling position switching mechanism according to another embodiment of the present invention, in a state during a surface pressure-applying/releasing operation.

In the aforementioned embodiment, the groove-shaped recess 94 and the through-hole 95 are provided in the drive unit-side coupling portion 9, and the through-hole 81 is provided in the slide metal frame-side coupling portion 8. In this embodiment, the groove-shaped recess 82 and the through-hole 83 are provided in the slide metal frame-side coupling portion 85 and the through-hole 96 is provided in the drive unit-side coupling portion 9, in reverse way. In the aforementioned embodiment, the during-casting coupling pin 10 is formed differently from the during-casting coupling pin 10. In this embodiment, each of the during-casting coupling pin 10 and the during-surface pressure-applying/releasing coupling pin 11 are formed as a common coupling pin 12 having an L shape.

In the aforementioned embodiment, the groove-shaped recess 94 is formed so as to open on the side opposite to the fixed metal frame. In this embodiment, the groove-like recess 82 is formed so as to open on the fixed metal frame-side. In short, in the present invention, the groove-like recess provided on one of the coupling portions may have an opening in such a manner that the slide metal frame is openable and closable in a state in which the coupling pin remains inserted in the groove-shaped recess.

It is obvious to a person of ordinary skill in the art that this embodiment can also bring out the same advantageous effects as those of the aforementioned embodiment.

LIST OF REFERENCE SIGNS

1: sliding nozzle apparatus
2: fixed metal frame
3: upper plate
4: slide metal frame
5: lower plate
6: openable-closable metal frame
7: hydraulic cylinder (drive unit)
71: drive rod
8: slide metal frame-side coupling portion
81: through-hole
82: groove-shaped recess
83: through-hole
9: drive unit-side coupling portion
91: base end frame
92: parallel frame
93: space
94: groove-shaped recess
95, 96: through-hole
10: during-casting coupling pin (coupling pin)
11: during-surface pressure-applying/releasing coupling pin (coupling pin)
12: coupling pin

The invention claimed is:

1. A slide metal frame-drive unit coupling position switching mechanism for use in a sliding nozzle apparatus configured such that a slide metal frame is slidingly moved with respect to a fixed metal frame according to forward or backward movement of a drive unit, to thereby apply or release a surface pressure in the sliding nozzle apparatus, the coupling position switching mechanism being operable to switchably change coupling of a slide metal frame-side coupling portion provided in the slide metal frame and a drive unit-side coupling portion provided in the drive unit, wherein a first coupling portion consisting of one of the slide metal frame-side coupling portion and the drive unit-side coupling portion is formed with a groove-shaped recess and a through-hole, and a second coupling portion consisting of a remaining one of the slide metal frame-side coupling portion and the drive unit-side coupling portion is formed with a through-hole, wherein the first coupling portion and the second coupling portion are configured such that, during a casting operation, the first and second coupling portions are coupled together by a first coupling pin inserted into the through-hole of the first coupling portion and the through-hole of the second coupling portion, and during a surface pressure-applying/releasing operation, the first and second coupling portions are coupled together by a second coupling pin inserted into the groove-shaped recess of the first coupling portion and the through-hole of the second coupling portion.

2. The slide metal frame-drive unit coupling position switching mechanism as recited in claim 1, wherein during the surface pressure applying/releasing operation, the drive unit is located above the first and second coupling portions, and wherein, the groove-shaped recess and the through-hole of the first coupling portion are arranged in an order from a side of a distal end of the first coupling portion.

3. The slide metal frame-drive unit coupling position switching mechanism as recited in claim 1, wherein when the drive unit is at a forward limit position thereof, surface pressure is released, so that the slide metal frame becomes openable and closable.

4. The slide metal frame-drive unit coupling position switching mechanism as recited in claim 1, wherein the first coupling portion comprises a base end frame, and two parallel frames extending from the base end frame in a sliding direction of the slide metal frame, the first coupling portion having a space defined between the two parallel frames in such a manner to enable the second coupling portion to be fitted thereinto.

5. The slide metal frame-drive unit coupling position switching mechanism as recited in claim 1, wherein the groove-shaped recess of the first coupling portion has a width greater than an inner diameter of the through-hole of the second coupling portion.

6. The slide metal frame-drive unit coupling position switching mechanism as recited in claim 1, wherein during the surface pressure applying/releasing operation, a central axis of a driving rod of the drive unit and a longitudinal central axis of the slide metal frame are located in a same straight line.

7. The slide metal frame-drive unit coupling position switching mechanism as recited in claim 1, wherein the second coupling pin has a U-shape.

* * * * *